United States Patent [19]

Carr et al.

[11] Patent Number: 4,714,630

[45] Date of Patent: Dec. 22, 1987

[54] METHOD AND APPARATUS FOR APPLYING ADHESIVE TO THE EDGES OF OPEN CONTAINER ENDS

[75] Inventors: Christopher Carr; William T. Rembold, both of Cincinnati, Ohio

[73] Assignee: The Procter & Gamble Company, Cincinnati, Ohio

[21] Appl. No.: 848,676

[22] Filed: Apr. 4, 1986

[51] Int. Cl.[4] ..... B05D 5/10; B05C 1/02

[52] U.S. Cl. ..... 427/207.1; 118/210; 118/223; 118/227; 427/208; 427/285

[58] Field of Search ..... 427/207.1, 208.2, 208.6, 427/284, 285, 286, 208; 118/210, 227, 221, 222, 223, DIG. 3

[56] References Cited

U.S. PATENT DOCUMENTS

| | | | |
|---|---|---|---|
| 513,642 | 1/1894 | Jones . | |
| 1,064,738 | 6/1913 | Jenkins . | |
| 1,316,805 | 9/1919 | Replogle . | |
| 1,912,553 | 6/1933 | Wagner . | |
| 2,124,722 | 7/1938 | Walter | 91/51 |
| 2,365,775 | 12/1944 | Punte | 91/49 |
| 2,388,911 | 11/1945 | Fink | 91/50 |
| 2,447,528 | 8/1948 | Paynter | 91/49 |
| 2,531,914 | 11/1950 | Lager et al. | 226/80 |
| 3,074,613 | 1/1963 | Cupo | 229/39 |
| 3,090,351 | 5/1963 | Coyne | 118/223 |
| 3,185,130 | 5/1965 | Pratt | 118/228 |
| 4,413,587 | 11/1983 | Cook | 118/210 |

*Primary Examiner*—Evan K. Lawrence
*Attorney, Agent, or Firm*—Richard C. Witte; John V. Gorman

[57] ABSTRACT

An apparatus and method for applying adhesive to the open ends of containers having oppositely disposed front and rear wall panels, oppositely disposed side panels, and a center line parallel to the front and rear wall panels and aligned with the center of the side wall panels. The apparatus includes a conveyor for moving the containers along a line of movement through an adhesive application area. The containers are substantially immovably supported during adhesive application procedures. A pair of rotary adhesive applicators apply adhesive to the edges and portions adjacent such edges of an open end of the containers. These rotary adhesive applicators each have a central axis which is oriented in a non-normal relationship to at least one of the center line and line of movement of such containers, and are arranged relative to the conveyor such that as the containers pass the applicators, such applicators contact the edges of an open end of the container panels. A relative speed differential is maintained between the containers being moved along the conveyor and the rotating adhesive applicators. This differential causes a predetermined amount of adhesive to be deposited on the open edges and portions adjacent the edges of the wall panels when the rotating adhesive applicators contact such open edges of the container panels.

22 Claims, 5 Drawing Figures

METHOD AND APPARATUS FOR APPLYING ADHESIVE TO THE EDGES OF OPEN CONTAINER ENDS

TECHNICAL FIELD

This invention relates to a method and apparatus for applying adhesive to the distal and inside edges of the open ends of a container, and, more particularly, to a method and apparatus featuring the use of at least two rotary adhesive applicators which are oriented in a non-normal relationship to at least one of the center line and the line of movement of the containers as the containers are moved past such applicator rolls.

BACKGROUND ART

There are many examples of composite cartons and other containers commonly used in the packaging industry which comprise separate end pieces which have been adhesively attached to one or more open ends of such cartons and/or containers. There are a substantial number of patents disclosing apparatus and methods for the application of adhesive to the upper edges of cylindrically shaped containers in particular. For example, U.S. Pat. No. 2,447,528, which issued to H. J. Paynter on Aug. 24, 1948, discloses a machine for applying liquid glue to the inner and outer upper edge portions of a cylindrical fiber container body. In particular, the Paynter patent describes a rotary device including a disk and a co-acting ring which rotate in unison while holding the cylindrical container body therebetween, thereby transferring adhesive carried by the disk and the ring to the inner and outer marginal edge portions of the container body. The disk and ring are spaced apart from one another at a distance slightly less than the thickness of the container body, so that pressure can be brought against the body to hold the container therebetween and facillitate application of glue thereto. Similarly, U.S. Pat. No. 2,365,775, which issued to W. F. Punte on Dec. 26, 1944, illustrates an adhesive applying apparatus for cylindrical paper containers. Like the Paynter container treating machine, the Punte reference suggests an apparatus which places one end of a cylindrical container body between a pair of adhesive applicator rolls such that one of the applicator rolls engages the inside surface of the container body, while the other applicator rolls contacts the outside surface. The applicator rolls are equipped with adhesive reservoirs which deposit a predetermined coating of adhesive on the outer surfaces of such applicator rolls. In use, the Punte apparatus rotates the container body between these adjacent applicator rolls thereby applying adhesive to both the inner and outer surfaces of the container simultaneously.

U.S. Pat. No. 2,124,722, which issued to C. T. Walter on July 26, 1938, concerns an apparatus for applying material to the ends of tubular containers, wherein the tubular containers are rotated as they are passed by a revolving material applicator wheel. In particular, Walter describes an apparatus wherein a continuous film of congealable material is maintained on a revolving applicator wheel, and a cylindrical container is brought into tangential engagement with such revolving applicator wheel and moved across the surface thereof, thereby causing such material to be deposited on the distal edge of the container body in contact with the revolving applicator wheel and along the inner peripheral surface of the edge of the container. A similar apparatus for applying adhesive is disclosed in U.S. Pat. No. 2,388,911, which issued to H. A. Fink on Nov. 13, 1945. The Fink apparatus is also designed to apply adhesive to the end portions of cylindrical containers, and contemplates rotating the cylindrical containers along a track system which brings an end of the container body into contact with a rotating adhesive roll. Like the Walter apparatus, the Fink adhesive applicator rotates the container body as it is contacted against the rotating adhesive roll thereby causing the adhesive to be directly applied to the end of the container and also depositing a portion of the adhesive along the inner wall of the container. The Fink apparatus is also adjustable for application of adhesive to cylindrical containers of various overall height.

Another adhesive applicating device for cylindrical containers is disclosed in U.S. Pat. No. 4,413,587, which issued to Ronald Cook on Nov. 8, 1983. The Cook adhesive applicator utilizes a pair of worm screws to effectively tilt the can or tube-style container as it contacts a rotating adhesive roll. Cook suggests that by tilting the container in this manner, more precise control of the location of the glue bead applied to the container can be achieved. An endless belt imparts rotation to the can or tube and presses it against the worm screws during the adhesive application process. By controlling the speed of the two worm screws, the tube can be tilted as desired thereby controlling the precise contact between such rotating tube and the rotating adhesive roll.

Despite the relatively wide use of automatic equipment to apply adhesive to the upper edges of cylindrical containers, there remain problems in effectively and efficiently applying adhesive to the inner edges of container ends where such containers are not cylindrical in form. In particular, heretofore there has not been an efficient and effective method and apparatus for accurately and conveniently applying adhesive to the inside edges of substantially rectangular composite cartons on high speed machinery. Prior art structures and methods relied heavily on the ability to rotate the containers in order to achieve controlled automatic application of such adhesive. In this regard, such methods and equipment failed to provide for the easy manufacture and handling of such substantially rectangular containers, or other containers having generally non-cylindrical cross-sections.

SUMMARY OF THE INVENTION

It is an object of this invention to obviate the above-described problems.

It is another object of the present invention to provide an apparatus for applying adhesive to the upper portions of the open ends of containers having non-cylindrical cross-sections.

It is yet another object of the present invention to provide an apparatus and method for applying adhesive to the upper portions of the open ends of containers having non-cylindrical cross-sections, and which can handle large numbers of such containers on high speed automatic equipment.

It is also an object of the present invention to provide a relatively simple and reliable method and apparatus for applying a predetermined amount of adhesive or other fluid material to the upper portions of the open ends of containers having non-cylindrical cross-sections, and which can accommodate a wide variety of sizes of such containers with minimal changes necessary.

In accordance with one aspect of the present invention, there is provided an apparatus for applying fluid material such as adhesive to the open ends of containers having non-cylindrical cross-sections, oppositely disposed front and rear wall panels, oppositely disposed side panels and a center line parallel to the front and rear wall panels and aligned with the center of the side wall panels. The apparatus includes conveying means for moving such containers along a line of movement through an adhesive application area. The conveying means includes attachment means for substantially immovably supporting the containers thereon at least during adhesive application procedures. The apparatus further includes an adhesive application area including a pair of rotary adhesive applicators for applying adhesive to the open edges and portions adjacent such edges of the open ends of the containers. These rotary adhesive applicators each have a central axis which is oriented in a non-normal relationship to at least one of such center line and such line of movement of the containers, and are mounted relative the conveying means such that as the containers pass the applicators, the applicators contact the open edges of the container panels. Rotation control means maintain a relative speed differential between the containers being moved along the conveying means and the rotating adhesive applicators. This relative speed differential, in conjunction with the non-normal orientation of the applicators, causes a predetermined amount of adhesive to be deposited on the open edges and portions adjacent such edges of the open ends of the front rear and side wall panels when the rotating adhesive applicators contact the distal edges of the container panels. This simple apparatus and method can effectively and efficiently apply a predetermined bead of adhesive to the open ends of non-cylindrical containers on high speed automatic equipment.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE INVENTION

Figure 1:
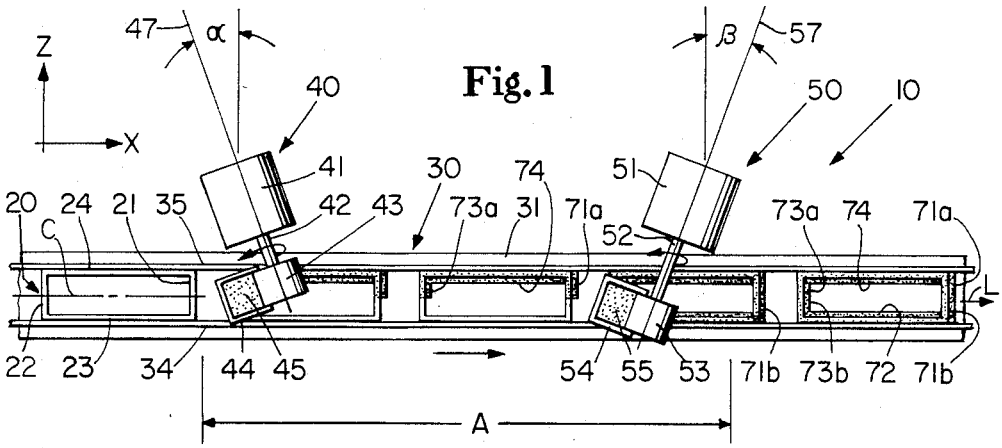
FIG. 1 is a top elevational schematic view of an apparatus for applying adhesive and made in accordance with the present invention.
Figure 2:
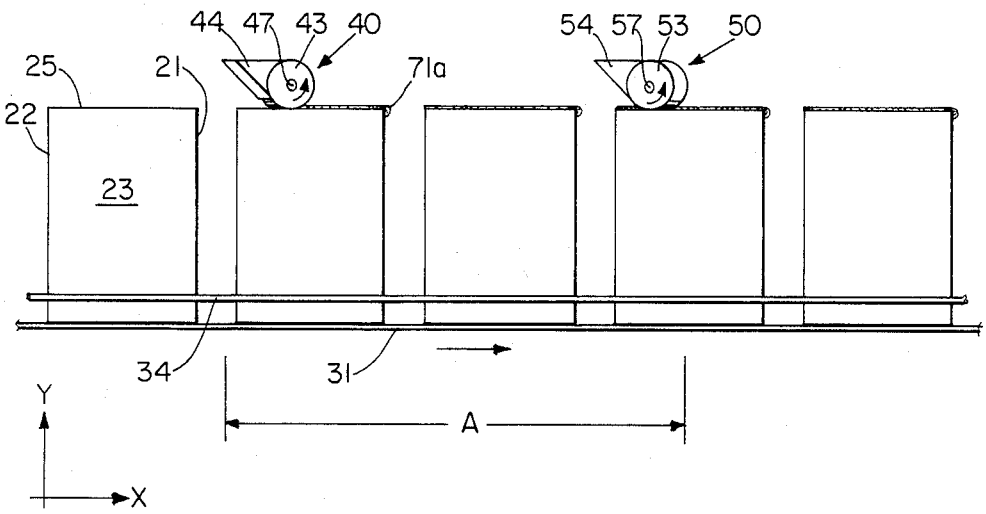
FIG. 2 is a side elevational schematic view of the apparatus for applying adhesive as shown in FIG. 1.

Referring now to the drawings in detail, wherein like numerals indicate the same elements throughout the views, an apparatus 10 for applying adhesive to the open end portions of containers 20 is shown as including a conveying means 30 for supplying containers 20 to the apparatus, and a pair of rotary adhesive applicators 40 and 50, respectively. As illustrated in FIGS. 1 and 2, each container 20 has an open end which is cooperatively defined by the coplanar distal edges of the wall panels 21, 22, 23 and 24. The container 20 is supplied by the conveying means 30 past the rotary adhesive applicators 40 and 50, whereby a bead of adhesive (71*a*and 71*b*) is applied to the distal edge and front upper portions of right sidewall 21 of container 20, and along the distal edges and upper inner surfaces (beads 74, 72 and 73*a* and *b*, respectively) of front and rear wall panels 23 and 24 and left sidewall panel 22, respectively. Following application of the adhesive beads 71 through 74, a closure or lid structure (not shown) may be applied to such containers thereby closing the open upper end thereof.

While the apparatus and process of the subject invention is shown and described in relation to applying adhesive to the upper open end of a container, it is also contemplated that both ends of the containers might be open, and that this procedure may be completed for both ends of such container, as desired. While the apparatus 10 is shown and described with adhesive applicators 40 and 50 mounted above conveying means 30 to apply adhesive to the upper open end of containers 20, it is also contemplated that applicators 40 and 50 could alternatively be placed below conveying means 30 to apply adhesive to the lower open ends of such containers. It may be preferred to mount applicators 40 and 50 above the moving containers, however, to minimize carton dust which may disrupt the gluing operation or find its way into the adhesive and compromise the integrity of any resultant seal created thereby on such containers. It has been found, however, that carton dust does not generally cause a problem in using the subject apparatus and method, as any such dust is commonly scraped off from the applicator rolls by a doctor blade roll cleaner (not shown) and by the scraping action of the adhesive application process described herein. Additionally, it is contemplated that the applicators of the subject invention may also be mounted adjacent the lateral sides of conveying means 30 (i.e., with the central axes of such applicators oriented substantially vertically, not unlike the adhesive applicators of a Krones' labeller device—available from Krones, Inc. of Franklin, WI) for similar application of adhesive to the open ends of cartons which are oriented with their open ends extending laterally outwardly in a direction normal to the line of movement thereof on the conveying means. Location of applicators 40 and 50 above or below conveying means 30, however, is preferred to such sideways or lateral arrangement, as adhesive thickness control and more critical timing and spacing requirements of the containers through the adhesive application area might make the sideways application procedures more complex and less reliable.

Conveying means 30 is illustrated as comprising an endless belt 31 which includes attachment means 34 and 35 which serve to contain the containers 20 in substantially immovable condition upon the upper surface of the moving belt 31. These attachment means are illustrated as stationary guide rails which limit lateral movement of containers 20, and are shown only as a simple example of the virtually unlimited ways in which such containers could be immovably supported on such conveying means. As used in this context, the term "substantially immovably supported" connotes the requirement that as containers 20 are moved past applicators 40 and 50, they do not move substantially relative to belt 31, thereby insuring that containers 20 will continue moving at a predetermined speed past such applicators. As will be seen, it is important to substantially immovably support such containers, at least during the adhesive application procedures, as controlled contact between the rotating adhesive applicators and the moving containers 20 is essential to establish a differential in the speed of movement of such applicators and containers. Other means of immovably supporting the containers on the conveying means 30 might include clamping means attached to belt 31 which prevent substantially all movement of the container on conveying means 30, while frictional force or various detents might also be sufficient to prevent movement of such containers thereon. The use of guide rails and/or other clamping apparatus to substantially immovably support containers 20 on conveying means 30 are commonly used in the packaging industry, and, therefore, shall not be described in detail herein.

Containers 20 are shown as being substantially evenly spaced along conveying means 30; however, while some space is required between the moving containers to allow for the application of external glue bead 71, such spacing can vary and its uniformity is not critical. It can be easily understood that if two successive containers 20 had no space between them, the left side wall of the first container and the right side wall of the second container would be abutting, and might interfere with the placement of beads 73 and 71, respectively, on such first and second container. Additionally such lack of spacing might interfere with subsequent lid application to such containers.

Figure 3:
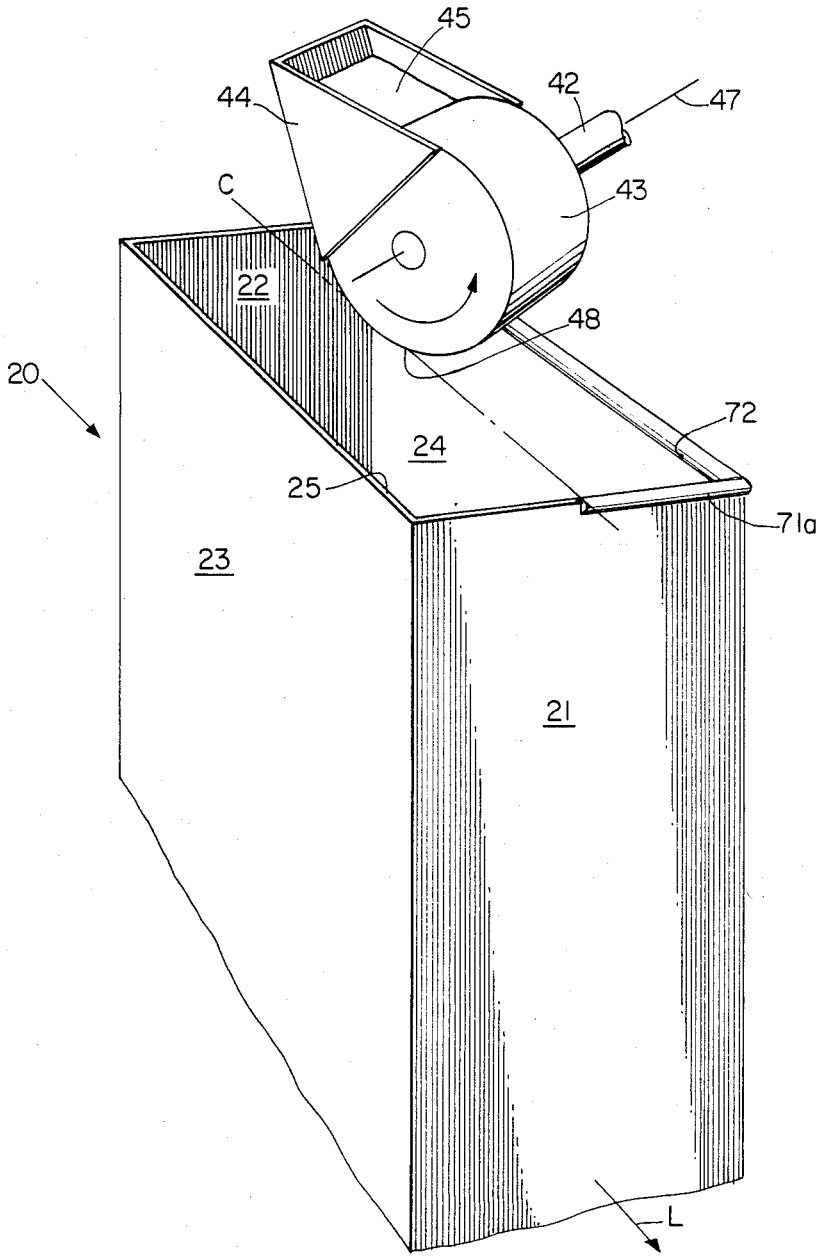
FIG. 3 is an enlarged simplified perspective view of a portion of the apparatus of FIG. 1, specifically showing contact between one of the rotary adhesive applicators and the distal edges of an open end of a moving container.

Endless belt 31 of conveying means 30 supplies containers 20 to an adhesive application area or station (designated as area A in FIGS. 1 and 2) where a pair of rotary adhesive applicators 40 and 50 are situated. Conveying means 30 moves containers 20 along a definable line of movement L. As illustrated, it is preferred that the line of movement L be substantially parallel to the center line C (as hereinafter defined) of containers 20, such that a predetermined orientation of the rotary adhesive applicators can be maintained vis-a-vis the front and rear walls (e.g., 23 and 24) of the moving containers. As shown in FIGS. 1 through 3, and as mentioned above, the rotary adhesive applicators (e.g. 40) are preferably located above conveying means 30 such that as containers 20 are moved along line of movement L, the lower surface (e.g. 48) of such applicators will contact the upper edge (e.g. 25) of each container 20 as it passes therebelow.

Rotary adhesive applicator 40 is illustrated as further comprising a source of rotational force 41, rotation transmission means or shaft 42 connecting such source of rotational force to rotary applicator roll 43 along the central axis 47 thereof, and an adhesive reservoir 44 designed to contain a supply of liquid adhesive or other fluid material 45 (hereinafter such adhesive or other fluid material will simply be referred to generally as "adhesive" or "adhesive material") to be applied to the open ends of such containers 20. The source of rotational force 41 is preferably simply an electric motor or similar device commonly used in the industry to drive rotary applicator equipment. Rotation transmission means 42 is preferably simply a drive shaft connecting the source of rotation 41 to applicator roll 43, as desired.

Applicator roll 43 and its adhesive reservoir 44 can be any substantially standard glue roll/reservoir combination commonly available in the industry (such as available from LTI Corporation, Monterey, Calif.).

Applicator roll 43 is rotated through reservoir 44 containing adhesive 45, with a predetermined thickness of such material 45 being deposited on the outer surface of applicator roll 43 as it rotates past a doctor blade (not shown) or similar thickness control apparatus, which preferably can be adjusted to corresponding alter such thickness. An applicator roll cleaner blade (also not shown) is often used to remove any excess adhesive or other extraneous matter (e.g. container board dust) from the outer surface of applicator roll 43 before it enters the reservoir 44. As it is contemplated that many of the commonly available applicator roll/adhesive reservoir combinations generally available in the industry could be utilized herein, specific details of rotary adhesive applicators 40 and 50 are not included herein. For example, vertical adjustment means can be provided for varying the position of adhesive applicators 40 and 50 in relation to conveying means 30 to accommodate containers 20 of varying heights.

Generally, adhesive applicator rolls (e.g., 43 and 53) are steel or similar metal. Commonly, when steel glue rolls coated with a thin coating of adhesive material contact paperboard or similar carton material, the adhesive is deposited on such paperboard surface as a result of molecular or chemical attraction. The adhesive is attracted and adheres more readily to the paperboard surface than to the smooth metal surface of the glue roll, and therefore transfers to such paperboard surface. This common phenomenon is generally utilized in standard glue roll/application procedures, but it tends to only deposit a limited amount of adhesive on the surface actually contacted by the glue roll. In the subject apparatus and method, this molecular or chemical application phenomenon is supplemented by unique glue roll orientation to apply additional adhesive to the wall surfaces adjacent the open edges which contact such glue rolls.

Rotary adhesive applicators 40 and 50 are illustrated as each having their central axis (47 and 57, respectively) oriented in a non-normal relationship to the center line C and the line of movement L of containers 20. As illustrated in FIG. 1, center line C is a line parallel to front wall 23 and rear wall 24 passing through the center of right and left side walls 21 and 22, respectively. Generally speaking, this center line could be defined for the open end of any container having oppositely disposed front and rear wall panels and oppositely disposed (and possible multi-sided) right and left side wall ponces, as line in the plane of the distal edges of the wall panels forming the opening and which is parallel to such front and rear wall panels and passes through the central axis of such container in alignment with the center of the side wall panels. Adhesive applicator 40 is preferably oriented in an outward direction from the center line C of containers 20 (i.e. the open face or surface of applicator roll 43 opposite adhesive reservoir 44 faces in a generally outward direction from center line C and line of movement L of containers 20). Such outward skewed relationship of applicator roll 43 to the center line is further quantified by the angle $\alpha$ which as shown in FIG. 1 is the angle between a line perpendicular to center line C in the plane of the distal edges and central axis 47. It has been found that orienting the applicator rolls in such a non-normal manner (i.e. the central axis of the applicator roll is not oriented perpendicularly to a vertical plane parallel to center line C of containers 20) provides a scraping action at the point of contact between the rotating applicator roll (e.g. 43) and the open edges 25 of containers 20 as container 20 passes rotary adhesive applicator (e.g. 40). This scraping action can be advantageously utilized to accurately and conveniently apply an additional amount or bead of adhesive to the distal edges 25 and upper portions of an open end of containers 20 on high speed equipment. As seen in FIGS. 1 and 2, this non-normal relationship criticality is limited to the orientation of the applicator rolls in the x-z plane (i.e. the lower surface of applicator rolls 40 and 50 are substantially horizontal). While applicator rolls 40 and 50 might be tipped up or down in the y-z plane, it is preferred that they remain substantially horizontal as shown in FIG. 2 to provide a substantially uniform surface of contact with the open edges 25 of containers 20.

It has also been found that the size of the bead of such material can be accurately controlled and varied as desired by manipulating certain variables. In particular, it has been found that for a constant viscosity of fluid material or adhesive, speed of movement of containers through the apparatus, and thickness of adhesive on the surface of the applicator rolls, the amount of adhesive material deposited in a bead along the outer surface of right sidewall 21 and along the inner surfaces of front and rear walls 23 and 24, respectively, and left sidewall 22 can be effectively and accurately controlled by varying the angle of orientation of the rotary adhesive applicators 40 and 50. This can also be accomplished by varying the thickness of the adhesive on the applicator rolls, and/or by varying the differential speed of applicator rolls 43 and 53 relative to the speed of movement of containers 20 along conveying means 30. It is preferred that when two oppositely disposed rotary adhesive applicators are utilized, such as shown in FIGS. 1 and 2, each of the applicators should include applicator rolls of sufficient width to contact one half of the cross-sectional width of the open end of a container 20 so that the two adhesive applicators in combination can adequately apply such adhesive to the open end of a container 20 as it is passed by such applicator rolls. Of course, this width relationship is not critical if more than two adhesive applicators are utilized in the process.

As shown in FIGS. 1 and 3, it is preferred that the innermost point of contact (e.g. 48) of applicator roll 40 be located such that it extends inwardly one half of the outer width of a container 20 to insure that the adhesive 45 will be applied to the rear half of the upper edges 25 of such container (i.e., along beads 71*a*, 74 and 73*a*). Similarly, rotary adhesive applicator 50 is preferably situated in a corresponding oppositely oriented relation to applicator 40 in order to apply adhesive to the front half portion of a container 20 (i.e., along beads 71*b*, 72 and 73*b*). Like applicator 40, adhesive applicator 50 is oriented in an outward direction from the inside of a container and has its central axis 57 similarly skewed to the center line C so that the axis 57 lies at an angle $\beta$ as measured from a line perpendicular to center line C in the plane of the distal edges. While the exact values of angles 60 and $\beta$ are not critical (and need not be equal to one another), in order to achieve the described scraping action of such adhesive material (e.g. 45 or 55) onto a container 20 from the outer surface of the applicator rolls 43 or 53, the central axes of such adhesive applicators can not be oriented in a normal (i.e. at a 90° angle) relationship to both the center line C and the line of movement L of containers 20. While it is preferred that line of movement L be parallel to center line C, such need not always be true. For example, containers could be supported on the conveying means such that their center lines are oriented at an angle to the line of movement of such containers (not shown). However, it has been found that in all cases the adhesive applicators must be oriented in a non-normal relationship to at least one of the center line and the line of movement of such containers for the desired scrapping action to be provided. If the applicators are oriented normal to both the center line and the line of movement of the containers, no scraping action would be provided and adhesive would be deposited substantially only on the distal edges of the front and rear walls of the containers. While the diameter of the bead of adhesive applied in a specific application of the subject invention can be varied by varying the angle at which the rotary adhesive applicators are oriented, any non-normal angle can be used to achieve the desired scraping action. It is preferred, however, that angles $\alpha$ and $\beta$ of between about 5° and 40° be utilized for optimal performance.

As illustrated in FIGS. 1 and 2, it is preferred that rotary applicators 40 and 50 be rotated in a counter-clockwise direction as containers are moved from left to right. In this regard, it is preferred that applicator roll surfaces 43 and 53 be moving in generally the same direction as the direction of movement L of containers 20 at the points of contact therebetween. The word "generally" is used here to connote that the applicator rolls will have a component of movement in the same direction as the movement of such containers. Because the applicator rolls are to be oriented in a non-normal relationship to at least one of the center line C and the line of movement L of the containers, the direction of rotation of such applicator rolls will not always be exactly in the same direction as the moving containers. When not rotating in exactly the same direction as the line of movement L (which can only happen if the applicator rolls are oriented normally to line of movement L), however, the movement of the applicator rolls can be likened to a vector having a component in the direction of center line C and/or the line of movement L of the containers, and a component normal thereto. Moving the applicator rolls generally in the same direction as the movement of the containers minimizes unnecessary friction in the system and helps to maintain a smooth, high speed flow of such containers through adhesive application area A; while the component of movement of such rolls normal to center line C and/or line of movement L establishes an outward scraping action of such rotating rolls vis-a-vis the container walls of the moving containers.

Figure 4:
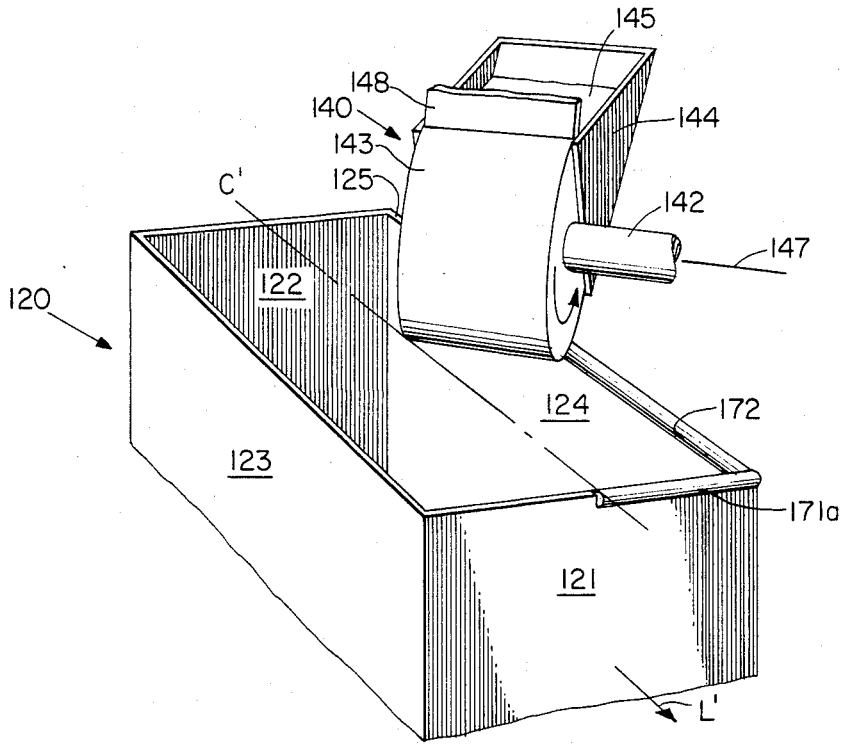
FIG. 4 is an enlarged simplified perspective view of a portion of an apparatus made in accordance with the present invention, in which a rotary adhesive applicator is oriented in an alternate non-normal relationship, also illustrating adhesive application to the distal edges of an open end of a moving container.

It is also contemplated that the applicator rolls could be oriented inwardly toward the center of the moving containers (i.e. the open face or surface of an applicator roll opposite the adhesive reservoir is oriented in a generally inward direction toward the center line C and line of movement L of the containers). In such case, if it were desired to place the adhesive beads 71 through 74 on the same surfaces as described and shown in FIGS. 1 through 3, then the rotation of such inwardly oriented applicator rolls would need to be in a clockwise direction, as shown in FIG. 4. Rotating roll 143 in a clockwise direction, as indicated in FIG. 4, establishes a component of movement of roll 143 in an outward direction normal to center line C' of container 220, thereby facilitating deposit of adhesive 145 on the inner surface of rear wall 124 (bead 172). Consequently, although such clockwise rotation would be generally in the opposite direction to the direction of movement L' of containers 120, it would maintain the desired scraping action thereby depositing the adhesive 145 on the outer surface of right sidewall 121 (bead 171*a*), the inner surface of rear wall 124 (bead 172), and the inner surface of left sidewall 122 (this bead not shown in FIG. 4). Doctor blade 148 is illustrated as part of adhesive reservoir 144, such doctor blade maintaining a predetermined thickness of adhesive 145 on the outer surface of applicator roll 143.

The speed of rotation of the applicator rolls of the subject invention can be manipulated relative the moving containers on the conveying means to determine both the location and size of the material beads deposited on such containers. For instance, speeding up adhesive roll 43 in FIG. 3 (without changing the speed of movement of containers 20 on conveying means 30) would cause a greater amount of adhesive to be deposited along bead 72. Location of such bead may also be determined by alteration of such rotational speed. For example, if applicator roll 43 in FIG. 3 is turning at a rotational speed whose component parallel to center line C and the direction of line of movement L is less than the speed of containers 20 in the direction of line of movement L, then the material would be deposited as shown in FIG. 3. If, on the other hand, applicator roll 40 is rotating at a speed whose component parallel to center line C and the line of movement L is greater than the speed of movement of container 20 along line of movement L, then adhesive 45 would be deposited on the inner surface of right sidewall 21, thereby placing bead of adhesive 71*a* on the interior surface of container 20. It can thus be seen that the speed differential between applicator roll 40 (or any applicator roll oriented in accordance with those teachings) and the moving containers 20 could be varied during application procedures for an individual container to, for example, place bead 71*a* on the interior of the upper surfaces of sidewall 21, then slowed to deposit beads 72 and 73*a*, as shown in FIGS. 1 and 3. Such speed differential manipulation would result in all beads being placed on the interior surfaces of an open container end. Finally, if applicator roll 43 were rotating at a speed whose forward component in the direction of line of movement L were equal to the speed of movement of container 20 in the direction of the line of movement L, then only a limited amount of adhesive would be placed on the outer or inner surfaces of the container walls by the described scraping action, and the deposited adhesive would be limited mainly to the upper edge 25 thereof as a result of the common molecular or chemical attraction of the adhesive to the container material, as described above. It is preferred that the rotary adhesive applicators be oriented outwardly vis-a-vis the center line C of containers 20 on conveying means 30, and that such applicators be rotated generally in the same direction as the movement of such containers at a speed whose component in the direction of line of movement L is slightly less than the speed of such moving containers. Such speed differential causes more adhesive to be scraped from the applicators by the moving containers 20.

Figure 5:
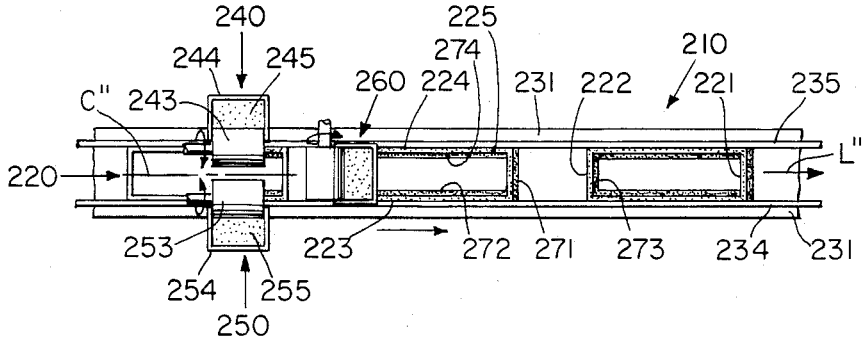
FIG. 5 is a top elevational schematic view of an alternate embodiment of an apparatus for applying adhesive made in accordance with the present invention.

FIG. 5 illustrates an alternate embodiment of the apparatus 210 of the subject invention wherein the pair of rotary adhesive applicators (240 and 250, respectively) are oriented with their central axes substantially parallel to the center line C" and line of movement L" and located above the moving containers 220 such that they contact the open edge 225 of front and rear walls 224 and 223, respectively, as the containers 220 pass therebelow on conveying means 231. While applicators 240 and 250 are not skewed to the center line C" and line of movement L", they are oriented such that their central axes are non-normal thereto, as described above. As shown in FIG. 5, rotary adhesive applicator rolls 243 and 253 are rotated in the directions indicated by the arrows through adhesive reservoirs 244 and 254, respectively, in order to deposit adhesive 245 and 255 along the inner portions of front and rear walls 223 and 224 adjacent the upper edge 225 (adhesive beads 272 and 274, respectively). A third rotary adhesive applicator 260 is illustrated as being oriented in a substantially normal relationship to center line C" and line of movement L" of containers 220, and being rotated in a clockwise direction as shown to contact at least the right and left sidewalls (221 and 222, respectively) to deposit beads 271 and 273 thereon. As is apparent from a comparison of FIG. 5 to FIG. 1, this alternate embodiment achieves substantially identical application of adhesive to the open end of such containers having non-cylindrical cross-sections. Apparatus 210 is shown only as an example of the many ways in which the apparatus of the subject invention can be modified to accommodate varying manufacturing requirements. In this regard, for containers having a hexagonal outer cross-section, a plurality of rotary adhesive applicators might be oriented in accordance herewith to deposit adhesive beads on the open ends of such containers.

The illustrated and described apparatus can advantageously be utilized to apply adhesives or other congealable material and the like to the upper edges and upper portions of the open ends of substantially rectangular containers. As mentioned above with respect to a hexagonal-shaped container, it is also contemplated that such apparatus and method can be applied to other multisided non-cylindrical containers by arranging two or more rotary adhesive applicators as described herein to apply such adhesive to the upper edges and upper portions of the open ends of such containers. As an example of the application of the subject method and apparatus to substantially rectangular containers having oppositely disposed front and rear wall panels (e.g. 23 and 24, as shown in FIG. 1) and oppositely disposed sidewall panels (e.g. right side panel 21 and left side panel 22 of FIG. 1), an apparatus as shown and described in FIGS. 1 through 3 can be utilized. Containers 20 may have, for example, a front and rear wall length of approximately 8.2" (20.53 mm) and a right and left side wall width of approximately 2.3" (approximately 5.76 mm), a height of approximately 11" (about 27.54 mm), and a wall thickness of approximately 0.025 inches (about 6.4 mm). Conveying means 30 preferably supplies containers 20 to application station A with their open ends oriented substantially vertically, and, as described above, includes attachment means (e.g., guide rails 34 and 35) for substantially immovably supporting the containers on the moving conveying means at least during adhesive application procedures. Conveying means 30 moves containers 20 through adhesive application area A at a predetermined speed such as, for example, about 80 feet per minute (about 24 meters per minute).

The adhesive applicators 40 and 50 apply adhesive to open distal edges 25 and portions adjacent those edges on the front, rear and side wall panels of the open end of containers 20 by contacting the open edges 25 as containers 20 are moved past applicators 40 and 50. As discussed above, adhesive applicators 40 and 50 are to be rotating at a predetermined speed (e.g. approximately 50 rpm for applicator rolls approximately 127 mm. in diameter), and preferably are oriented outwardly from the center line C of such containers. Additionally, it is preferred that applicators 40 and 50 be rotating at a predetermined speed somewhat slower than the corresponding movement of containers 20 along conveying means 30. While the speed differential can be adjusted as desired, it has been found that rotating applicators 40 and 50 at a speed of about 15% slower than the speed of the containers 20 works well when such adhesive applicators are skewed at an angle of about 15° (i.e., $\alpha$ and $\beta$ equal to approximately 15°) from line perpendicular to center line C and line of movement L of containers 20. While the thickness of the liquid material on the outer surface of adhesive applicator rolls 43 and 53 can be varied as desired, it has been found that a thickness of approximately 0.030 inches (about 0.76 mm) for adhesive having a viscosity of approximately 38,000 cp. will accurately and successfully deposit such adhesive on the upper edges 25 and the upper portions of the container wall panels such that beads 71 through 74 have a diameter of approximately 0.1 inches (2.5 mm). As described above, by modifying the variables of applicator roll speed and/or angle, both the location and amount of adhesive or liquid placement on the open ends of such containers can be accurately controlled using the method and apparatus of the subject invention.

Having shown and described the preferred embodiment of the present invention, further adaptions of the apparatus and method described herein can be accomplished by appropriate modifications thereto by one of ordinary skill in the art without departing from the scope of the present invention. For example, while it is preferred that the center line (e.g., C) of the containers be parallel to the line of movement (e.g., L) thereof, such need not be the case. The containers might be oriented such that their center lines are skewed vis-a-vis the line of movement thereof. The apparatus and method of the subject invention would work as described, however, as long as the pair of rotary adhesive applicators were oriented in a non-normal relationship to one or more of such center line and line of movement of such containers. Accordingly, the scope of the present invention should be considered in terms of the following claims and is understood not to be limited to the details of structure and operation shown and described in the specification and drawings.

We claim:

1. An apparatus for applying adhesive to the open end of a container, said container having oppositely disposed, parallel, front and rear wall panels, oppositely disposed side wall panels, said wall panels having distal edges which are coplanar and cooperatively define said open end, and a center line in the plane of said distal edges which is parallel to said front and rear wall panels and aligned with the center of said oppositely disposed side wall panels, said apparatus comprising:

(a) conveying means for moving said container along a line of movement through an adhesive application area of said apparatus, said conveying means including attachment means for substantially immovably supporting said container thereon at least during adhesive application procedures;

(b) an adhesive application area including a pair of rotary adhesive applicators for applying adhesive to said distal edges and portions adjacent said edges, said adhesive applicators each having an outer surface adapted to carry a layer of adhesive and a central axis which is oriented in a non-normal relationship to at least one of said center line and said line of movement of said container such that as said container passes said adhesive applicators, the rotary adhesive applicators contact said distal edges of said container wall panels; and (c) rotation control means for maintaining a relative speed differential between the container being moved along said conveying means and the rotating adhesive applicators, whereby contact of said rotating adhesive applicators and the open edges of said container wall panels causes a predetermined amount of adhesive to be deposited on the distal edges and portions adjacent said edges of said open end of said wall panels.

2. The apparatus of claim 1, wherein said center line and said line of movement are parallel to one another, and wherein the central axes of said adhesive applicators are oriented in a non-normal relationship to both such lines.

3. The apparatus of claim 2, wherein the central axes of said rotary adhesive applicators are skewed outwardly vis-a-vis the center line of movement of said container as it is moved along on said conveying means, and are rotated by said rotation control means in the same general direction as the movement of said container, whereby said predetermined amount of adhesive is deposited on the inner surfaces of said front and rear panels adjacent the open distal edges thereof.

4. The apparatus of claim 2, wherein the central axes of said rotary adhesive applicators are skewed inwardly vis-a-vis the center line of said container as it moves along said conveying means, and are rotated by said rotation control means in the generally opposite direction as the movement of said container, whereby said predetermined amount of adhesive is deposited on the inner surfaces of said front and rear panels adjacent the open distal edges thereof.

5. The apparatus of claims 1, 2, 3 and 4, wherein said container is supplied by said conveying means with its open end facing upwardly and wherein said rotary adhesive applicators are situated above said conveying means such that said container passes below said adhesive applicators.

6. The apparatus of claim 5, further comprising vertical adjustment means for varying the position of said rotary adhesive applicators in relation to said conveying means in order to accommodate containers of varying heights.

7. The apparatus of claim 1, wherein said center line of said container is not parallel to said line of movement of said container along said conveying means, and wherein the central axes of said applicators are oriented in a non-normal relationship to said center line.

8. The apparatus of claim 1, wherein said center line of said container is not parallel to said line of movement of said container along said conveying means, and wherein the central axes of said applicators are oriented in a non-normal relationship to said line of movement.

9. The apparatus of claim 2, said apparatus further comprising a third rotary adhesive applicator for applying adhesive to the distal edges and portions adjacent said edges of said side wall panels of said container, said third rotary adhesive applicator having a central axis which is oriented substantially normal to said center line and said line of movement of said container.

10. The apparatus of claim 5, wherein each of the central axes of said rotary adhesive applicators are oriented in said non-normal relationship at angles of between about 5° and about 40° to a line which is perpendicular to said center line of said container in the plane of said distal edges.

11. The apparatus of claim 10, wherein one of said rotary adhesive applicators is situated relative said moving container such that it contacts the distal edges of the front half of the open end of said container during adhesive application procedures, while the other of said pair of rotary adhesive applicators is situated relative said moving container such that it contacts the distal edges of the rear half thereof.

12. An apparatus for applying adhesive to the upper portions of the open ends of substantially rectangular containers, said containers each having oppositely disposed parallel, front and rear wall panels, oppositely disposed side wall panels, said wall panels having distal edges which are coplanar and cooperatively define said open end, and a center line in the plane of said distal edges which is parallel to said front and rear wall panels and aligned with the center of said oppositely disposed side wall panels of said container, said apparatus comprising:

(a) conveying means for moving said containers along a line of movement through an adhesive application area of said apparatus with said open ends of such containers facing upwardly, said conveying means including attachment means for substantially immovably supporting said containers thereon at least during adhesive application procedures;

(b) an adhesive application area including a pair of rotary adhesive applicators for applying adhesive to said distal edges and upper panel portions adjacent said edges of said containers, said adhesive applicators each having an outer surface adapted to carry a layer of adhesive and a central axis which is oriented in a non-normal relationship to at least one of said center line and said line of movement of said containers being moved along said conveying means such that as said containers pass below said adhesive applicators, the rotary adhesive applicators contact said distal edges of said container panels;

(c) vertical adjustment means for varying the position of said rotary adhesive applicators in relation to said conveying means; and (d) rotation control means for maintaining a relative speed differential between the containers being moved along said conveying means and the rotating adhesive applicators, whereby contact of said rotating adhesive applicators and the distal edges of the open end of said container panels causes a predetermined amount of adhesive to be deposited on the distal edges and upper portions adjacent said edges of said wall panels.

13. The apparatus of claim 12, wherein said center line of said containers and said line of movement are parallel to one another, and wherein said central axes of said adhesive applicators are oriented in a non-normal relationship to both such lines.

14. The apparatus of claim 13, wherein the central axes of said rotary adhesive applicators are skewed outwardly vis-a-vis the center line of said containers as they are moved along said conveying means, and are rotated by said rotation control means in the same general direction as the movement of said containers, whereby said predetermined amount of adhesive is deposited on the inner surfaces of said front and rear panels adjacent the upper distal edges of the open end thereof.

15. The apparatus of claim 13, wherein the central axes of said rotary adhesive applicators are skewed inwardly vis-a-vis the center line of said containers as they are moved along said conveying means, and are rotated by said rotation control means in the generally opposite direction as the movement of said containers, whereby said predetermined amount of adhesive is deposited on the inner surfaces of said front and rear panels adjacent the upper distal edges of the open end thereof.

16. The apparatus of claim 12, wherein said center lines of said containers are not parallel to said line of movement of said containers along said conveying means, and wherein the central axes of said applicators are oriented in a non-normal relationship to said center lines.

17. The apparatus of claim 12, wherein said center line of said containers are not parallel to said line of movement of said containers along said conveying means, and wherein the central axes of said applicators are oriented in a non-normal relationship to said line of movement.

18. The apparatus of claim 14, said apparatus further comprising a third rotary adhesive applicator for applying adhesive to the upper edges and upper portions of said side wall panels of an open end of said containers, said third rotary adhesive applicator having a central axis which is oriented substantially normal to the center line of said containers.

19. The apparatus of claims 12, 13, 14 or 15, wherein each of the central axes of said rotary adhesive applicators are oriented in said non-normal relationship at an angle of between about 5° and about 40° to a line which is perpendicular to said center line and said of movement of said containers in the plane of said distal edges.

20. The apparatus of claim 19, wherein one of said rotary adhesive applicators is situated relative said moving container such that it contacts the distal edges of the front half of the open end of said container during adhesive application procedures, while the other of said pair of rotary adhesive applicators is situated relative said moving container such that it contacts the distal edges of the rear half thereof.

21. A method for applying adhesive to the upper edges and upper portions of the open ends of containers, said containers each having oppositely disposed, parallel, front and rear wall panels, oppositely disposed side wall panels, said wall panels having distal edges which are coplanar and cooperatively define said open end, and a center line in the plane of said distal edges which is parallel to said front and rear wall panels and aligned with the center of said oppositely disposed side wall panels, said method comprising the steps of:

(a) supplying said containers along a conveying means to an adhesive application area along a line of movement established by said conveying means such that the center line of each container is substantially parallel to said line of movement;

(b) conveying said containers through said adhesive application area at predetermined speed, said containers being substantially immovably supported by attachment means on said conveying means at least during the time said containers are being conveyed through said adhesive application area; and (c) applying adhesive to the distal edges and portions adjacent said edges of said front, rear and side wall panels of said containers by contacting such open edges with two or more rotary adhesive applicators at said adhesive application area, said rotary adhesive applicators rotating at a predetermined speed and each having a central axis of rotation which is oriented in a non-normal relationship to at least one of said center line and said line of movement of such containers, said predetermined speed of such rotary adhesive applicators establishing a relative speed differential with said moving containers such that upon contact between said rotary applicators and the distal edges of a container, adhesive is removed from the applicators and deposited on said container along such distal edges and upper portions of said wall panels.

22. The method of claim 21, wherein said relative speed differential is established by rotating said rotary adhesive applicators in the same general direction as the moving containers at a speed slightly slower than such moving containers.

* * * * *

UNITED STATES PATENT OFFICE
CERTIFICATE OF CORRECTION

PATENT NO. : 4,714,630

DATED : December 22, 1987

INVENTOR(S) : Christopher Carr and William T. Rembold

It is certified that error appears in the above-identified patent and that said Letters Patent is hereby corrected as shown below:

| | | |
|---|---|---|
| Column 1, | line 38, | "facillitate" should read -- facilitate --. |
| Column 6, | line 59, | "ponces" should read -- panels --. |
| Column 6, | line 59, | after "as" insert -- a --. |
| Column 8, | line 2, | "60" should read -- $\alpha$ --. |
| Column 14, | line 51, | after "said" (second occurrence) insert -- line --. |

Signed and Sealed this

Twenty-sixth Day of September, 1989

*Attest:*

DONALD J. QUIGG

*Attesting Officer*

*Commissioner of Patents and Trademarks*